US007909530B2

(12) United States Patent
Okura

(10) Patent No.: US 7,909,530 B2
(45) Date of Patent: Mar. 22, 2011

(54) CONNECTION HARDWARE FOR WOODEN BUILDING

(75) Inventor: Kenho Okura, Namerikawa (JP)

(73) Assignee: Grandform Co., Ltd., Toyama (JP)

( * ) Notice: Subject to any disclaimer, the term of this patent is extended or adjusted under 35 U.S.C. 154(b) by 133 days.

(21) Appl. No.: 12/084,773

(22) PCT Filed: Nov. 14, 2006

(86) PCT No.: PCT/JP2006/322681
§ 371 (c)(1),
(2), (4) Date: May 9, 2008

(87) PCT Pub. No.: WO2007/055385
PCT Pub. Date: May 18, 2007

(65) Prior Publication Data

US 2009/0110473 A1 Apr. 30, 2009

(30) Foreign Application Priority Data

Nov. 14, 2005 (JP) ..... 2005-328959

(51) Int. Cl.
*E04B 1/26* (2006.01)

(52) U.S. Cl. ..... 403/331; 403/230; 403/340

(58) Field of Classification Search ..... 403/230, 403/331, 340, 381; 52/283, 289, 655.1, 702
See application file for complete search history.

(56) References Cited

U.S. PATENT DOCUMENTS

| | | | | |
|---|---|---|---|---|
| 739,020 | A * | 9/1903 | Michols | 5/296 |
| 924,912 | A * | 6/1909 | Maydl | 403/345 |
| 2,160,174 | A * | 5/1939 | Scalera | 5/296 |
| 2,311,537 | A * | 2/1943 | Giuseffi | 5/286 |
| 2,703,912 | A * | 3/1955 | Tinnerman et al. | 403/14 |
| 2,793,407 | A * | 5/1957 | Johnston | 403/182 |
| 4,189,796 | A * | 2/1980 | Gutner | 5/8 |
| 4,565,465 | A * | 1/1986 | Oberst | 403/187 |
| 4,646,497 | A * | 3/1987 | Hoenle | 52/285.2 |
| 5,284,311 | A * | 2/1994 | Baer | 248/243 |
| 5,727,358 | A * | 3/1998 | Hayashi et al. | 52/745.2 |
| 5,779,380 | A * | 7/1998 | Knapp | 403/331 |
| 6,669,396 | B2 * | 12/2003 | Mattle | 403/294 |
| 7,004,436 | B2 * | 2/2006 | Knapp | 248/220.22 |
| 7,175,207 | B2 * | 2/2007 | Prochiner | 285/124.1 |
| 7,188,908 | B2 * | 3/2007 | White et al. | 297/440.14 |
| 2008/0213040 | A1 * | 9/2008 | Morze-Reichartz | 403/381 |

FOREIGN PATENT DOCUMENTS

| | | | |
|---|---|---|---|
| JP | 08-120791 | | 5/1996 |
| JP | 2005350983 | A * | 12/2005 |

* cited by examiner

*Primary Examiner* — Joshua T Kennedy
(74) *Attorney, Agent, or Firm* — Louis Woo

(57) ABSTRACT

A technique to extensively increase the efficiency of the construction of large-size wooden building and to effectively use the loading space when materials for construction are transported fixes a basic hardware on a lateral surface of a longitudinal member with a subsidiary hardware on an end surface of a lateral member. The basic hardware has an upper tapered portion and a lower receiving portion and is affixed to the longitudinal member. The subsidiary hardware is affixed to the lateral member and has a lower tapered portion and an upper receiving portion that engage with the upper tapered portion and the lower receiving portion, respectively, of the basic hardware to join the longitudinal member and the lateral member together.

2 Claims, 10 Drawing Sheets

CONNECTION HARDWARE FOR WOODEN BUILDING

TECHNICAL FIELD

The present invention relates to a connection hardware for wooden building to be used for connecting longitudinal members (such as pillars, beams, crossbeams, etc.) with lateral members (such as beams, crossbeams, etc.).

BACKGROUND ART

In recent years, wooden buildings such as school buildings have been increasingly built by reflecting the tendency to increase and promote the comfort of the users. To meet such requirements, as the connection hardware primarily used in general type of housing, new types of hardware to match the large-size wooden building have appeared one type after another.

Patent Document 1 Japanese Patent Application Publication No. H8-120791

In case of large-size wooden building, extremely many component members are used in comparison with the detached single-family house. For the construction of large-size building, strict arrangement for the delivery of the building must be negotiated and agreed with the client in almost all cases. However, in the connection hardware of this type, troublesome procedure and high expenses are required at the construction site for the purpose of maintaining and ensuring sufficient connecting strength between the construction members, and construction efficiency is often decreased when such types of construction materials are used. Also, wooden materials are much inferior compared with the steel materials in the material strength. Therefore, in addition to the troublesome procedure of the construction as described above, damages may occur more frequently to lateral members and longitudinal members in case of wooden structure.

In order to reduce the working time at construction site for the connection of the longitudinal members with the lateral members, it is desirable that the connection hardware is mounted at the factory in advance. However, when the connection hardware is mounted in advance on the longitudinal members and the lateral members, more loading space is required when these are transported because the length of the projection of connection plates from the wooden materials is longer.

When these materials are carried by transport means such as trucks, this means that loading capacity of the transport means is reduced, and this may result in higher costs due to the lower efficiency of the material transport and may cause extensive delay in the delivery time of the building.

DISCLOSURE OF THE INVENTION

To overcome the problems as described above, it is an object of the present invention to provide a connection hardware for wooden building, by which it is possible to extensively increase the efficiency of the construction of large-size wooden building, to effectively use the loading space when materials for construction are carried from factories and other places because the extent of projection of hardware from the materials where it is used is far less than in the conventional case. Moreover, when the hardware is connected, a force to pull lateral members toward longitudinal members can be induced.

The present invention provides a connection hardware for wooden building, which comprises a basic hardware to be fixed on a lateral surface of a longitudinal member and a subsidiary hardware to be fixed on an end surface of a lateral member, wherein said subsidiary hardware is accommodated in an accommodation space provided on an end surface of the lateral member and has through-holes, through which fastening pieces as passed from a lateral surface of the lateral member 2 are inserted, said subsidiary hardware being connected and fixed by mounting pieces on a bottom surface of said accommodation space, said subsidiary hardware further comprises an upper receiving portion having a longitudinal hole surrounded by a band strip and also a lower tapered portion having an inclined surface on lower part, said inclined surface being gradually inclined up toward the lateral member, said basic hardware is connected by means of mounting pieces on a lateral surface of the longitudinal member, an upper tapered portion is disposed on upper part of the basic hardware, said upper tapered portion being engaged into said longitudinal hole of said upper receiving portion and having an inclined surface gradually inclined up toward said lateral member, a lower receiving portion is arranged where said lower tapered portion can be engaged into a longitudinal hole surrounded by a band strip, said longitudinal hole of said upper receiving portion has an inner surface on projecting side of said longitudinal hole being designed as an inclined surface gradually inclined up toward said lateral member, and inner surface on projecting side of the longitudinal hole of the lower receiving portion has an inclined surface gradually inclined upward toward the longitudinal member.

As the means for mounting the basic hardware on the longitudinal member, lag screws may be used, for instance. Or, it may be fixed by means of bolts. The number of the lag screws to be installed can be adequately changed, depending on the size of wooden material or on the size of connection hardware. For instance, two lag screws may be connected in parallel at left and right positions on lateral surface of the wooden material or three lag screws may be connected at three positions arranged in vertical direction. Further, band strip can be used, which has lower thickness compared with the block and which can be firmly held by engaging it with each of the upper and the lower tapered portions. For instance, open side of a U-shaped metal piece may be welded together with the block, or a U-shaped metal strip may be used. As the fastening pieces, drift pins, bolts, etc. may be used.

When the connection hardware as described above is used and the subsidiary hardware is set to and engaged with the basic hardware, the lower tapered portion of the subsidiary hardware is engaged into a longitudinal hole of the lower receiving portion of the basic hardware, and it is slid along an inclined surface in the longitudinal hole and is moved downward. At the same time, the upper tapered portion of the basic hardware is engaged into the longitudinal hole of the upper receiving portion of the subsidiary hardware, and it is moved upward along an inclined surface in the longitudinal hole. As a result, the subsidiary hardware is pulled toward the longitudinal member, and the upper and the lower tapered portions are placed into the longitudinal holes of the upper and the lower receiving portions respectively. Thus, the deviation of the hardware in left or right direction and separation can be prevented, and the connecting condition of the longitudinal member and the lateral member by the connection hardware can be maintained with high accuracy. Moreover, because the upper tapered portion is placed and engaged into the longitudinal hole of the upper receiving portion, and because the lower tapered portion is placed into the longitudinal hole of the lower receiving portion, the basic hardware and the subsidiary hardware are connected together. Therefore, when moment of rotation is applied on the connecting portion between the longitudinal member and the lateral member, the upper receiving portion and the lower receiving portion are connected together in band-like shape. As a result, the upper receiving portion and the lower receiving portion with the thickness lower than the other portion of the connection hardware are pulled first. Then, these are stretched and tightened in response to the applied force, and the closely fitted connection based on the performance characteristics of iron materials can be accomplished. This extensively reduces the transmission of the impact force on wooden material side.

Because the subsidiary hardware is accommodated in an accommodation space, in a slit, and in an insertion hole, when it is mounted on the lateral member, the loading space is the same as the space required for the lateral member alone.

According to the present invention, each of the upper and the lower tapered portions is slid along the inclined surface of each of the upper and the lower receiving portions and is pulled toward the longitudinal member. As a result, the basic hardware is connected with the subsidiary hardware. A force is applied in a direction to push and press the end surface of the lateral member to the lateral surface of the longitudinal member, and this contributes to the increase of the connecting strength between the longitudinal member and the lateral member. Because the basic hardware is connected with the subsidiary hardware as described above, these can be easily connected together by simply dropping the lateral member from above to the longitudinal member, and this extensively increases the working efficiency.

By dividing the connection hardware to the basic hardware and the subsidiary hardware, occupying space per each of the longitudinal member with the basic hardware and the lateral member with the subsidiary hardware can be extensively reduced compared with the conventional case. This means that loading space can be reduced when these members are transported together if the basic hardware and the subsidiary hardware are mounted in advance at the factory. This leads to more effective utilization of the loading space. Further, connecting conditions can be maintained for long time, and this means that the collapse of the materials occurs far more slowly when upper structure is burned in case of fire, and that dew condensation due to heat bridge can be prevented.

BEST MODE FOR CARRYING OUT THE INVENTION

According to a first embodiment of the connection hardware for wooden building of the present invention, there are provided a basic hardware 3 to be fixed on lateral side of a longitudinal member 1 and a subsidiary hardware 4 to be accommodated in an end surface of a lateral member 2.

Lag screws 14*a* and 15*a* are screwed in advance into the longitudinal member 1 where the basic hardware 3 is to be fixed. The lag screws 14*a* and 15*a* are mounted on the longitudinal member 1 through embedding holes, which are formed on the central portion in lateral direction on the side surface of the longitudinal member 1.

The lag screw 15*a* and a lag screw 15*b* as to be described later may not necessarily be mounted because these are provided for the purpose of reinforcement.

Figure 1:
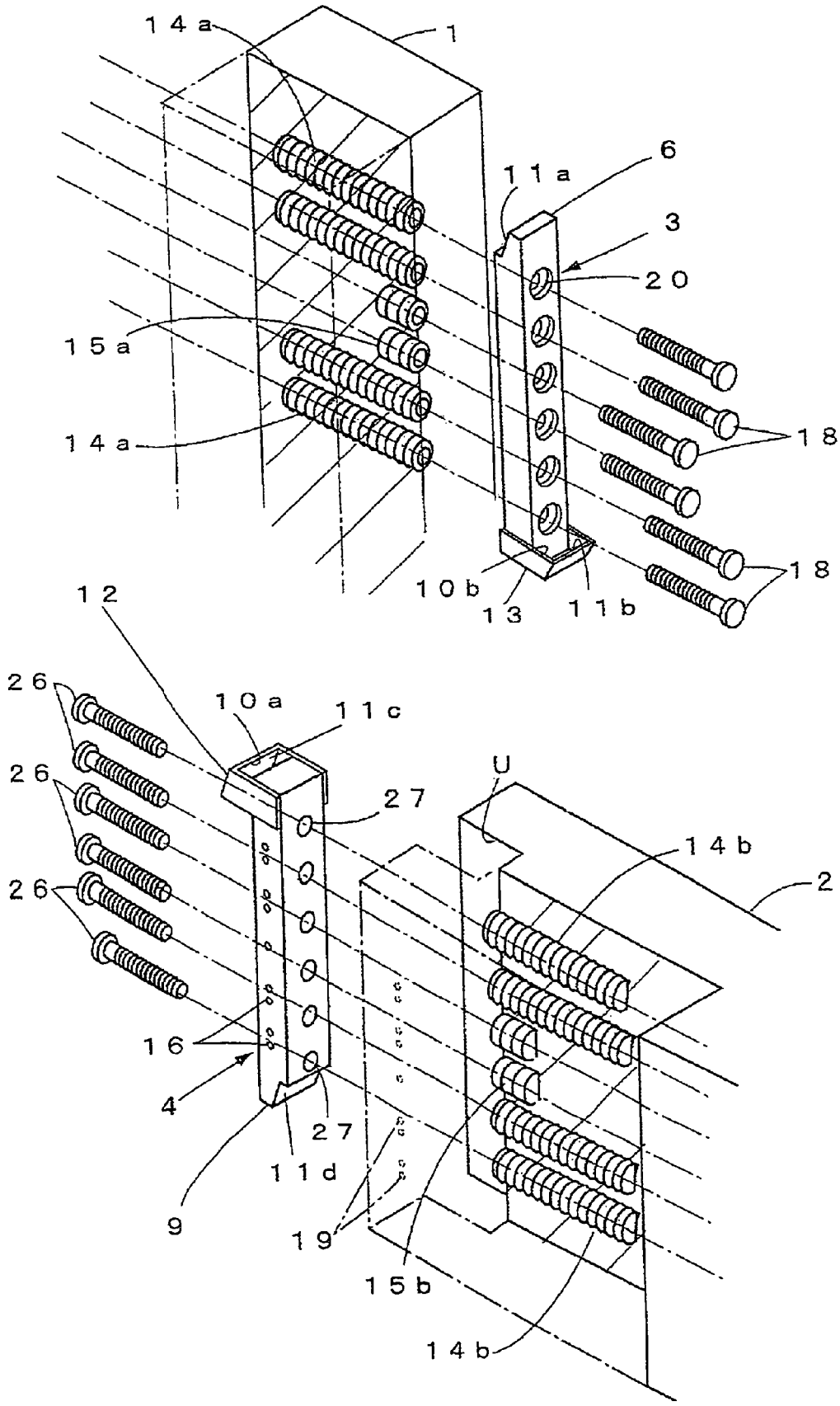
FIG. 1 represents perspective views, each to explain initial stage of the procedure to use the connection hardware for wooden building according to the invention.
Figure 2A:
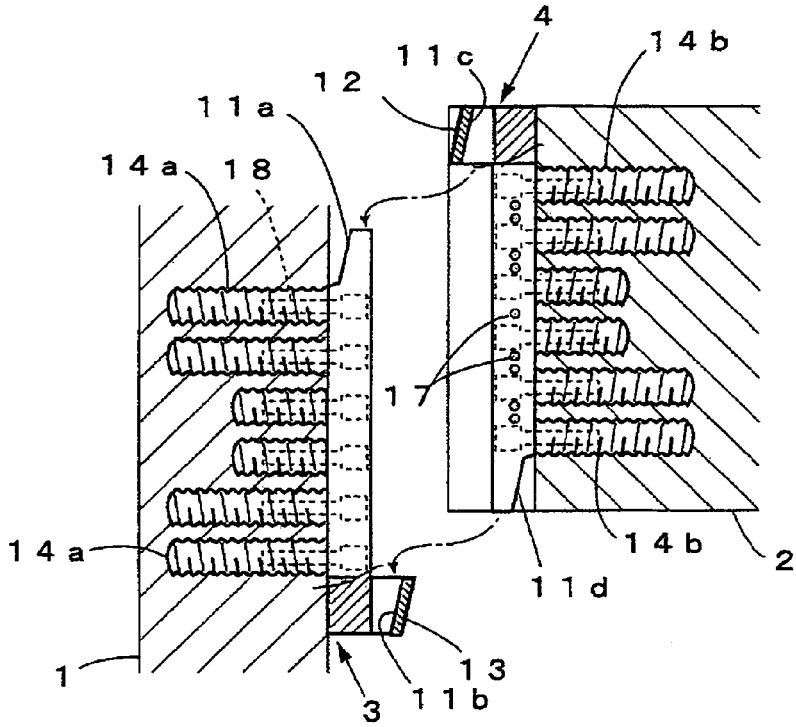
FIG. 2A represents a side view to explain the procedure for mounting the connection hardware in wood building as shown in FIG. 1.
Figure 2B:
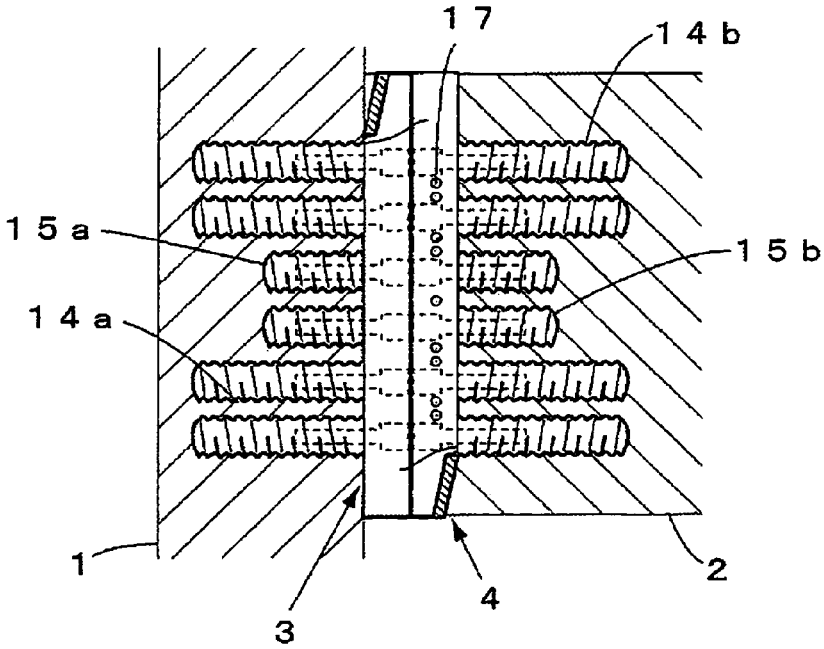
FIG. 2B is a side view to explain the procedure for mounting the connection hardware in wood building as shown in FIG. 1.

As shown in FIG. 1 and FIGS. 2A and 2B, the basic hardware 3 is designed in form of oblong blocks each having a prismatic shape except for its lower receiving portion. The basic hardware 3 is threaded on the lag screws 14*a* and 15*a* through the embedding holes. The lag screws 14*a* and 15*a* are screwed in at two points located with a fixed distance between them in vertical direction on the lateral surface of the longitudinal member 1. An upper tapered portion 6 is disposed above the basic hardware 3, and a lower receiving portion 13 is disposed under the basic hardware 3. The upper tapered portion 6 has an inclined surface 11*a*, which is gradually inclined downward from top surface toward the longitudinal member 1. The lower receiving portion 13 is a metal piece designed in U-shaped form with its opened portion welded together with the lower end of the basic hardware 3. Thus, a longitudinal hole 10*b* surrounded by the metal piece is formed. A surface of the longitudinal hole 10*b* closer to the lateral member 2 on inner wall surface surrounded by the metal piece is designed as an inclined surface, which is gradually inclined down toward the longitudinal member 1. Further, it is so arranged that the shape and the size of the longitudinal hole 10*b* are approximately equal to the shape and the size of the lower tapered portion 9 of the subsidiary hardware 4.

Figure 3:
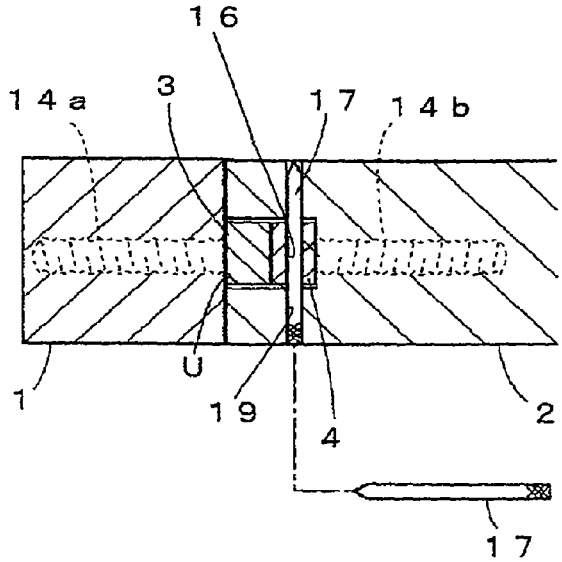
FIG. 3 is a plan view to show a condition where a drift pin is inserted into a subsidiary hardware to pass through as shown in FIG. 2B.

On the other hand, as shown in FIG. 1 and FIGS. 2A and 2B, the subsidiary hardware 4 is designed in form of blocks each having a prismatic shape except for its upper receiving portion. Each of the subsidiary hardware 4 pairs with a basic hardware 3 as described above. More concretely, at the upper portion of the subsidiary hardware 4, a U-shaped metal piece is disposed with its opened side facing toward the longitudinal member 1, and the opened portion is welded together with an upper end of the subsidiary hardware 4, and a longitudinal hole 10*a* is formed by a space surrounded by the metal piece and the lateral surface of the subsidiary hardware 4. The surface of the longitudinal hole 10*a* in the inner wall surface surrounded by the metal piece and positioned closer to the longitudinal member 1 is designed as an inclined surface 11*c*, which is gradually inclined up toward the lateral member 2. Further, the shape and the size of the longitudinal hole 10*a* are designed to be approximately equal to the shape and the size of the upper tapered portion 6 of the basic hardware 3 as described above. In order to mount the subsidiary hardware 4 on the lateral member 2, fixing bolts 26 are placed into counterbored holes 27 and 27 disposed at two points on upper and lower portions of the subsidiary hardware 4 respectively, and tip of each of the fixing bolts 26 is screwed into the lag screws 14*b* and 15*b* buried in the lateral member 2 respectively. Further, through-holes 16 are provided at a plurality of points with a fixed distance between them in vertical direction. As shown in FIG. 3, drift pins 17 from the lateral side of the lateral member 2 are penetrated into the through-holes 16 respectively, and this is helpful in reinforcing the connecting strength between the subsidiary hardware 4 and the lateral member 2.

The connection hardware of the first embodiment as described above is used according to the following procedure: First, as shown in FIG. 2A, the lag screws 14*a* and 15*a* are screwed into the embedding holes located at two points, i.e. at upper and lower positions, on the central portion in lateral direction of the longitudinal member 1, and these lag screws are fixed on the longitudinal member 1. To mount the lag screws 14*a* and 15*a* on the basic hardware 3, head of each of the fixing bolts 18 is inserted into the counterbored holes disposed at two points, i.e. at upper and lower positions, on lateral surface of the basic hardware 3. Tip of each of the fixing bolts 18 projecting from abutted surface of the basic hardware 3 facing toward the longitudinal member 1 is screwed into each of the bolt holes positioned closer to the lag screws 14*a* and 15*a* respectively. Next, the subsidiary hardware 4 is mounted on the lateral member 2 approximately in the same manner as the case of the basic hardware 3. In particular, of detailed description is given on a case different from the basic hardware 3, the exception from the case of the basic hardware 3 is that the embedding holes for the lag screws 14*b* and 15*b* are arranged at the depth of an accommodation space U of the lateral member 2. Then, the subsidiary hardware 4 is mounted as it is accommodated in the accommodation space (recess), and it does not protrude from the end surface of the lateral member 2.

Figure 4:
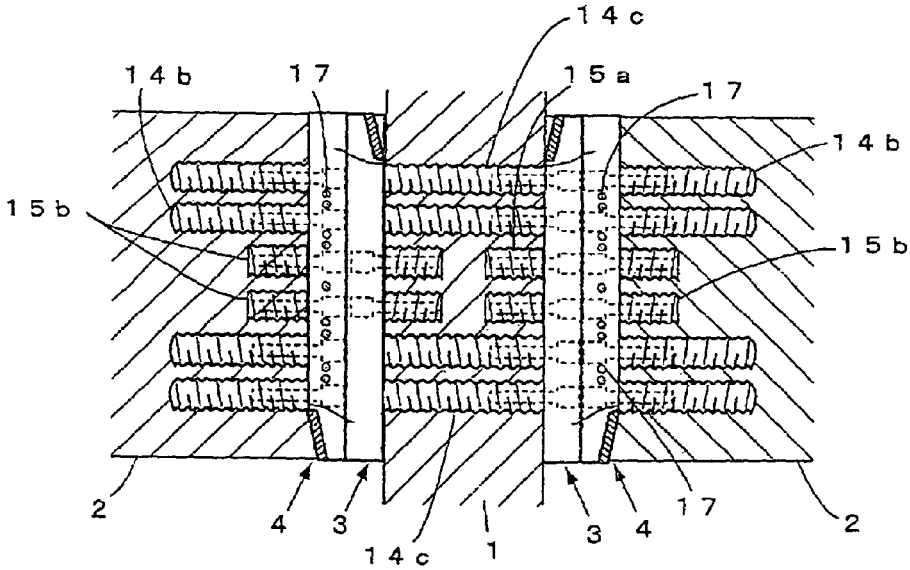
FIG. 4 is a side view to show an application example of the connection hardware for wooden building in a first embodiment of the invention.

The basic hardware 3 mounted on the longitudinal member 1 is connected with the subsidiary hardware 4 mounted on the lateral member 2 by the following procedure (see FIG. 2B): The lateral member 2 mounted with the subsidiary hardware 4 is dropped onto the longitudinal member 1 mounted with the basic hardware 3. The lower tapered portion 9 of the subsidiary hardware 4 is slid along the inclined surface 11*b* of the longitudinal hole 10*b* on the lower receiving portion 13 of the basic hardware 3. Also, an inclined surface 11*c* of the longitudinal hole 10*a* on the upper receiving portion 12 of the subsidiary hardware 4 is slid along the inclined surface 11*a* of the upper tapered portion 6 of the basic hardware 3. As a result, the subsidiary hardware 4 is slid diagonally downward and is abutted on the basic hardware 3. In this case, the subsidiary hardware 4 is relatively and slightly pulled toward the longitudinal member 1. This is helpful to eliminate the shakiness caused by unstable contact between the lateral surface of the longitudinal member 1 and the end surface of the lateral member 2. The end surface of the lateral member 2 is pushed and pressed with strong force to the lateral surface of the longitudinal member 1, and this reinforces the connecting strength between the longitudinal member 1 and the lateral member 2. Further, as shown in FIG. 4, it is also possible to mount the lateral members 2 and 2 on the left side and on the right side of the longitudinal member 1 respectively. In this case, by using a lag screw 14*c* commonly used for the left side and the right side, the connecting strength can be maintained between the longitudinal member 1 and each of the lateral members 2 and 2.

Figure 5A:
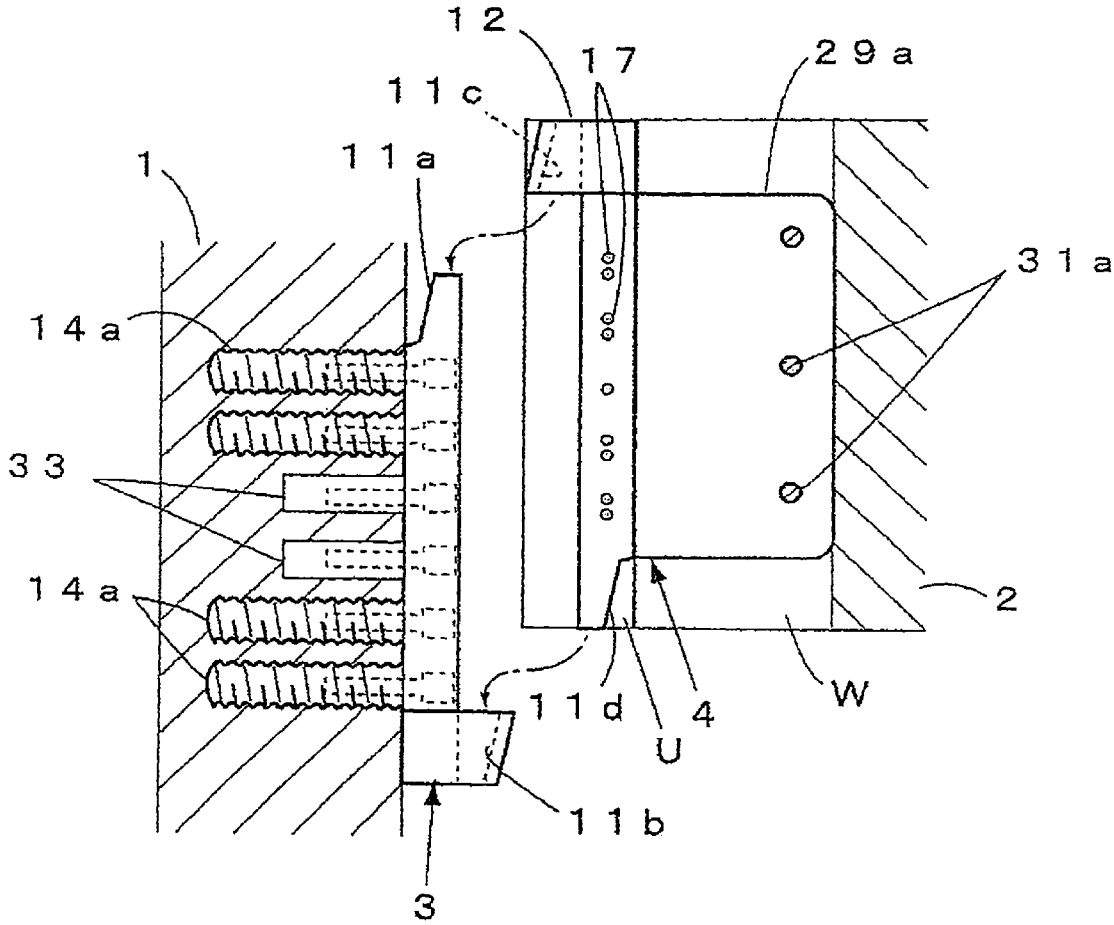
FIG. 5A is a side view to explain the procedure for mounting the connection hardware for wooden building in a second embodiment.
Figure 5B:
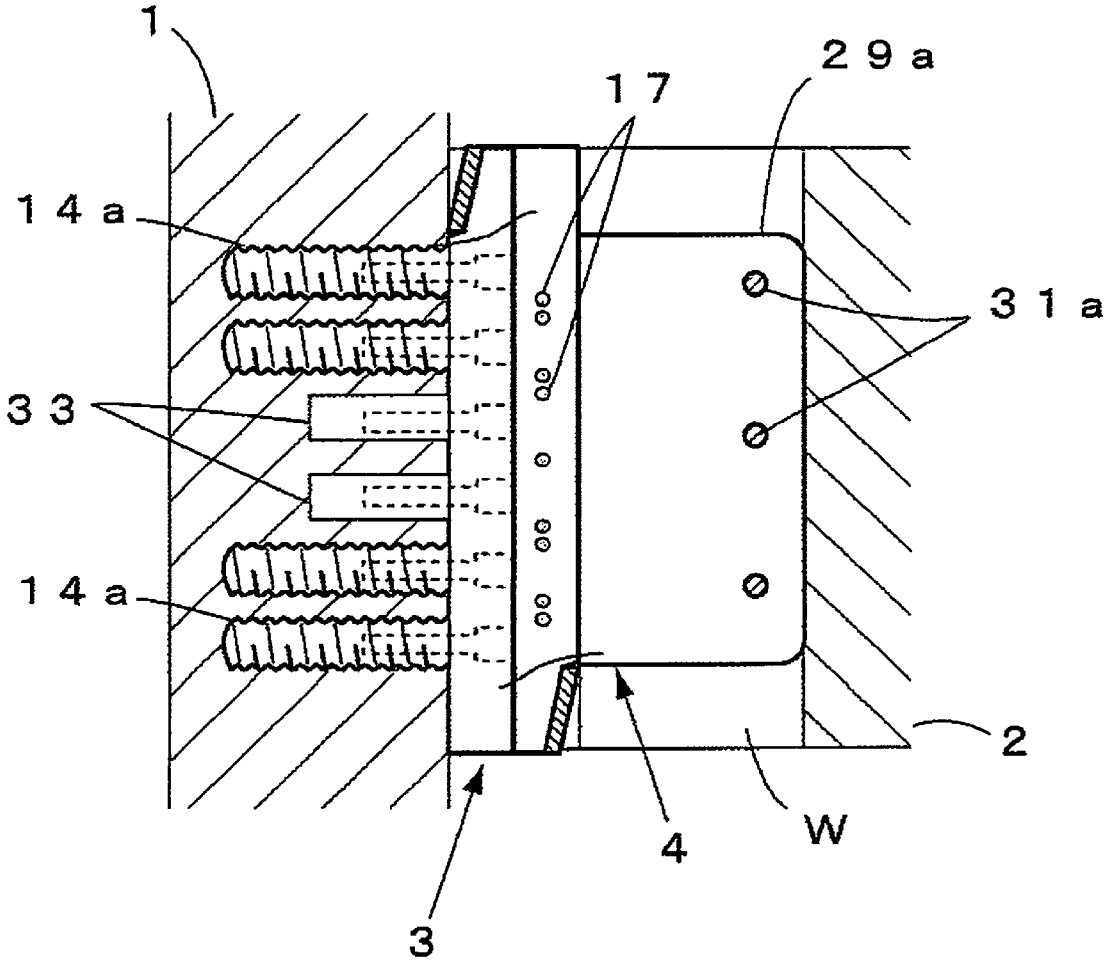
FIG. 5B is a side view to explain the procedure for mounting the connection hardware for wooden building in a second embodiment.

In the second embodiment of the connection hardware for wooden building according to the present invention, the subsidiary hardware 4 integrated with a connecting piece 29*a* is used as shown in FIG. 5A and FIG. 5B. The connecting piece 29*a* has a length in vertical direction to concur with that of the subsidiary hardware 4. At three points arranged in vertical direction with the same distance between them on lateral surface of the connecting piece 29*a*, through-holes are formed respectively so that drift pins 31*a* (hereinafter simply referred as "drift pin") for the connecting piece 29*a* can be inserted. On the other hand, on the central portion in lateral direction at the depth of the accommodation space (recess) U of the lateral member 2, there is provided a slit W, into which the connecting piece 29*a* is to be inserted. In order to mount the subsidiary hardware 4 on the end surface of the lateral member 2, the connecting piece 29*a* is placed into the slit W and the drift pins 31*a* are driven from the lateral surface of the lateral member 2. As a result, the drift pins 31*a* pass through the through-holes of the connecting piece 29*a*, and this prevents the connecting piece 29*a* from being dropped out.

Reference numeral 33 denotes shafts, each to be used as a mounting piece in this embodiment, and these may be used for both of the longitudinal member 1 and the lateral member 2 instead of the use only for the longitudinal member 1 or only for the lateral member 2.

Figure 6A:
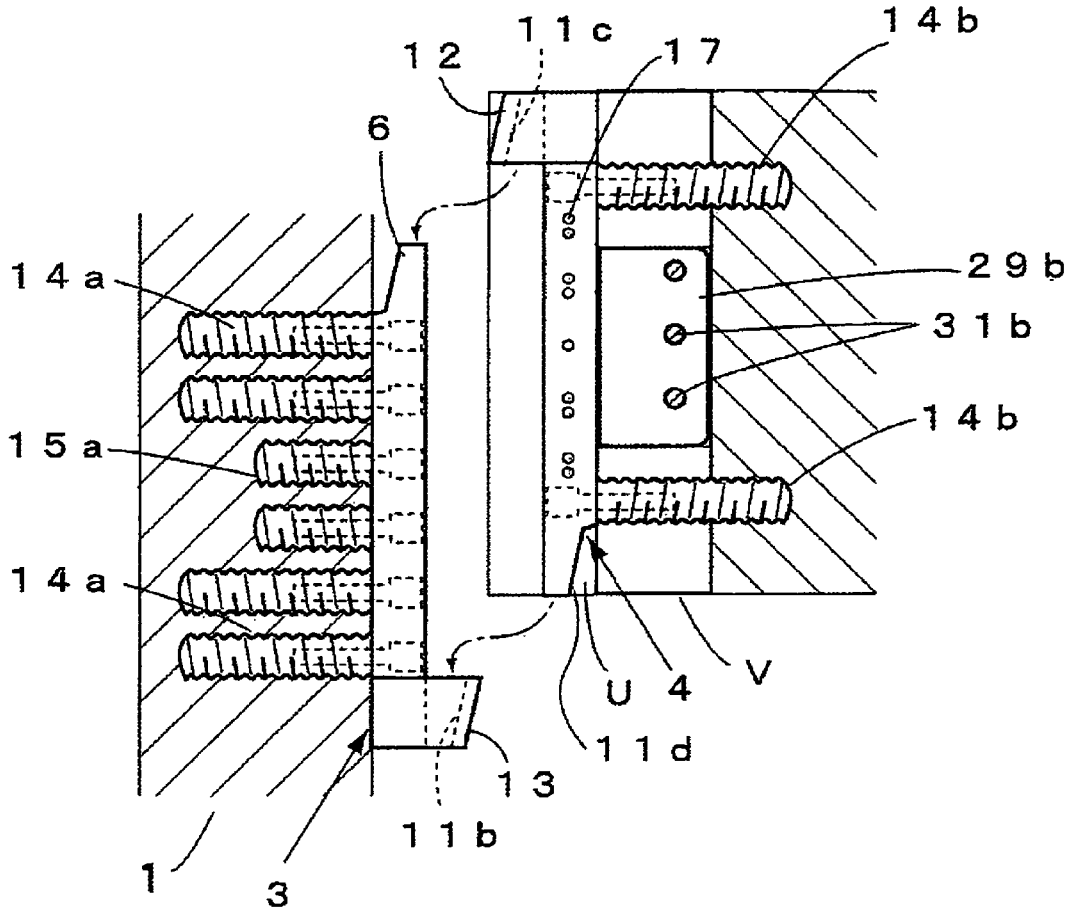
FIG. 6A is a side view to explain the procedure for mounting the connection hardware for wooden building in a third embodiment.
Figure 6B:
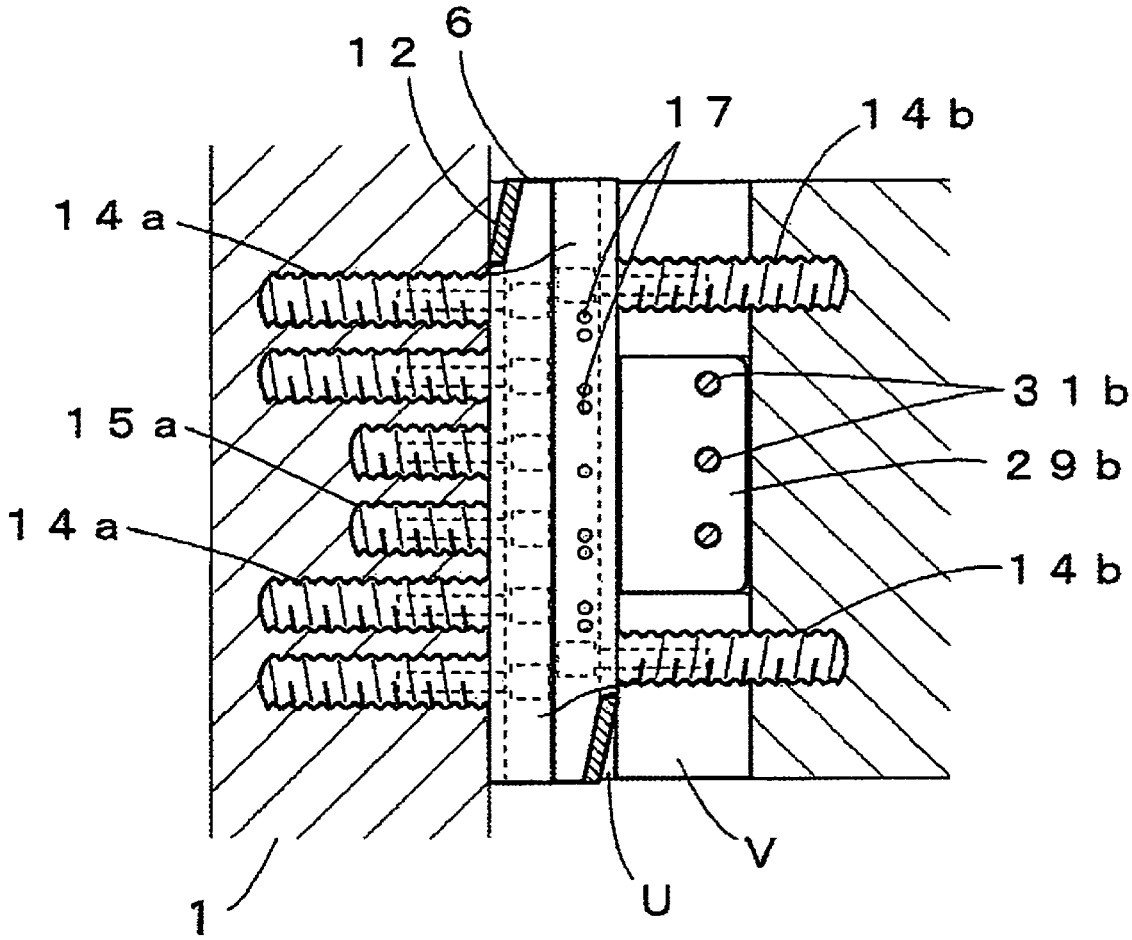
FIG. 6B is a side view to explain the procedure for mounting the connection hardware for wooden building in a third embodiment.

FIG. 6A and FIG. 6B each represent a third embodiment of the connection hardware for wooden building of the present invention. In this connection hardware, embedding holes for lag screws 14*b* are arranged at two points, i.e. at upper and lower positions, with a fixed distance between them in an accommodation space U of the lateral member 2, and a slit V for the connecting piece 29*b* is provided. On the subsidiary hardware 4, a connecting piece 29*b* is integrally mounted in a manner similar to the second embodiment, while the length in vertical direction of the connecting piece 29*b* is designed to be shorter than the case of the subsidiary hardware 4. This is because it is necessary to maintain a space for fixing the subsidiary hardware 4 and the lag screw 14*b* by bolts, and the connecting piece 29*b* is inserted between the upper and the lower screws 14*b* and 14*b* at upper and lower positions. In the procedure to mount the subsidiary hardware 4, after the subsidiary hardware 4 and the lag screws 14*b* and 14*b* have been fixed by bolts, the drift pins 31*b* are driven from the lateral side of the lateral member 2. Then, tip of each of the drift pins 31*b* is passed through the through-holes of the connecting piece 29*b*respectively, and the connecting piece 29*b* is inserted into the slit V so that the connecting piece 29*b* is prevented from coming out of the lateral member 2.

Figure 7A:
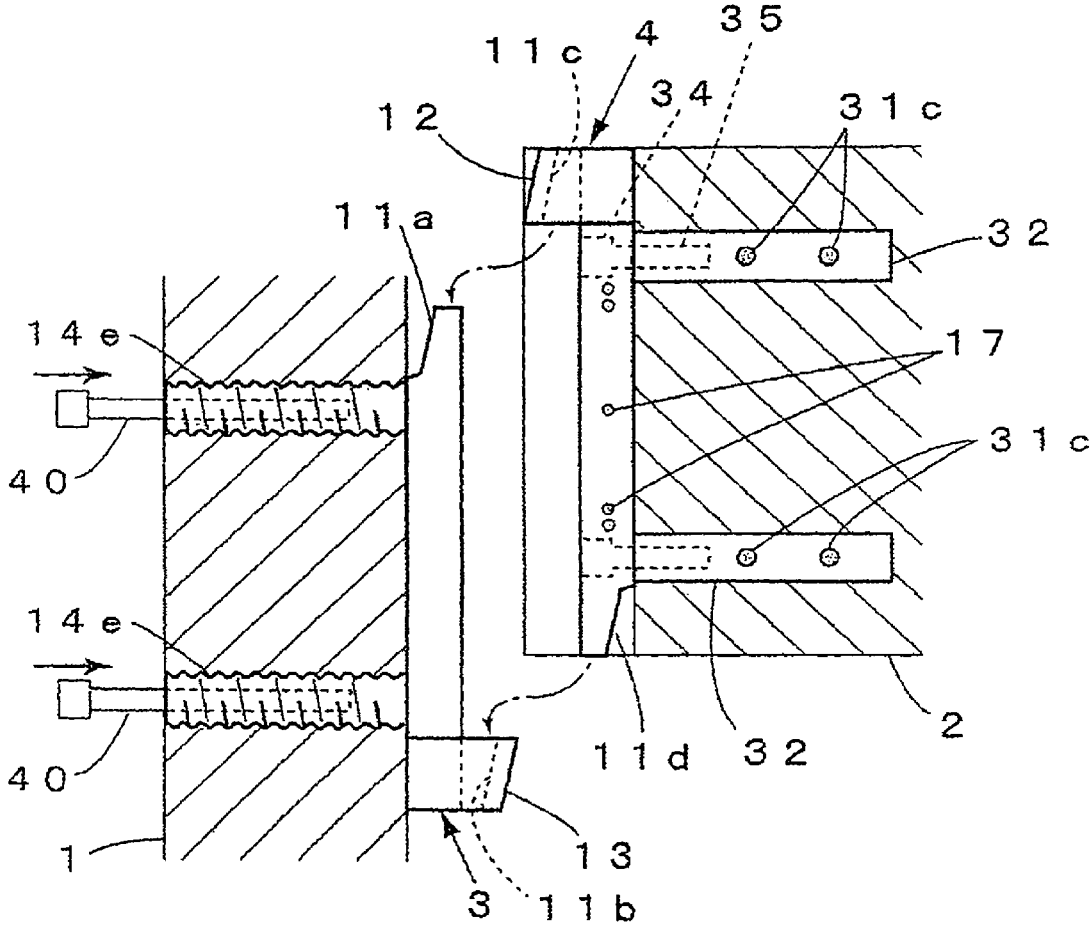
FIG. 7A is a side view to explain the procedure for mounting the connection hardware for wooden building in a fourth embodiment.
Figure 7B:
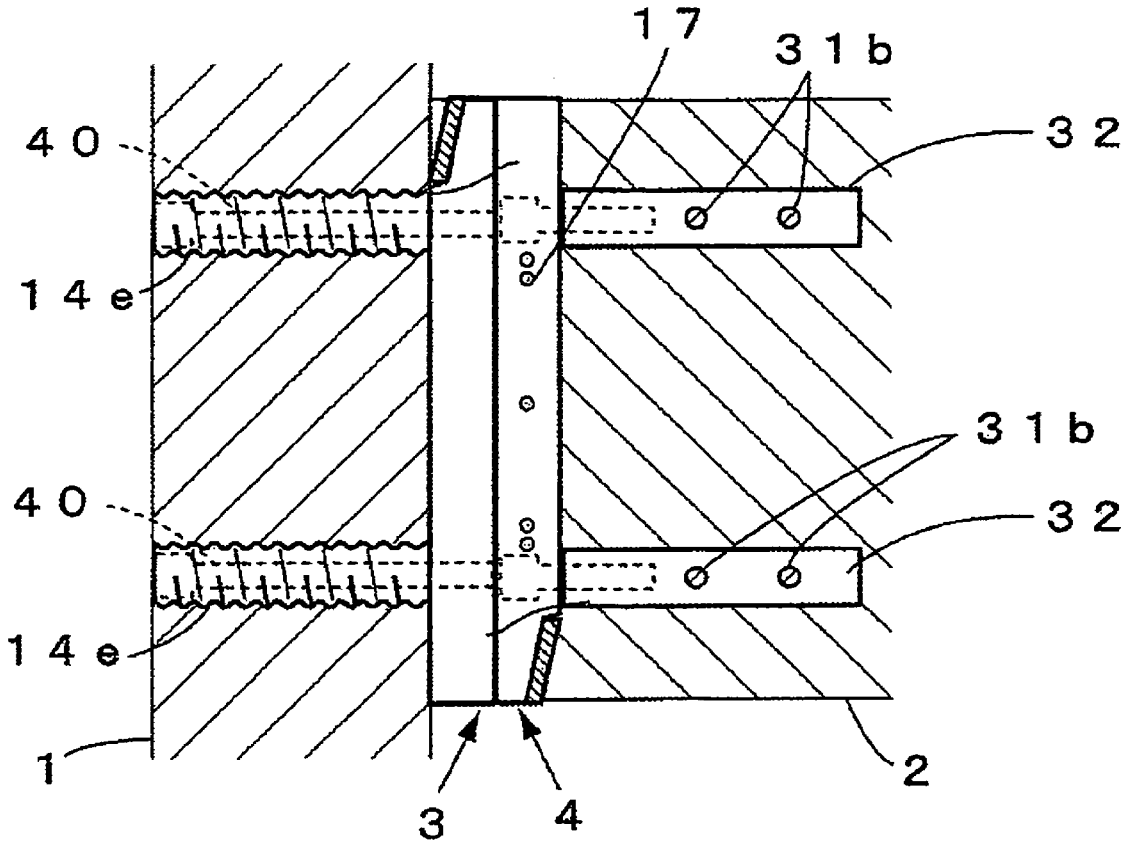
FIG. 7B is a side view to explain the procedure for mounting the connection hardware for wooden building in a fourth embodiment.

FIG. 7A and FIG. 7B each represents a side view of a fourth embodiment of the connection hardware for wooden building of the present invention. In this connection hardware, an insertion hole is arranged at each of two points with a fixed distance between them in vertical direction and disposed at the depth of the accommodation space U, and a connecting rod 32 is inserted into each of these insertion holes. On each of the connecting rods 32, through-holes for drift pins 31*c* penetrating in lateral direction are provided at two points located with a fixed distance between them in left-to-right direction. When each of the connecting rods 32 is inserted, the drift pins 31*c* are driven from the lateral side of the lateral member 2 and are passed through the through-holes so that the connecting rods 32 are prevented from being dropped off. Also, when the subsidiary hardware 4 is mounted, the subsidiary hardware 4 is placed into the accommodation space U of the lateral member 2. Then, each of bolts 35 is inserted into each of counterbored holes 34 of the subsidiary hardware 4 respectively. By screwing each of the bolts into the lateral member 2, the projected tip of each of the bolts 35 is fitted into each of the bolt holes on each of the connecting rods 32.

In this embodiment, as the lag screws where the basic hardware 3 is to be mounted, lag screws 14*e* are used, which are threaded on bolts 40 respectively from the side opposite to the side where the basic hardware 3 of the longitudinal member 1 is to be mounted.

Figure 8:
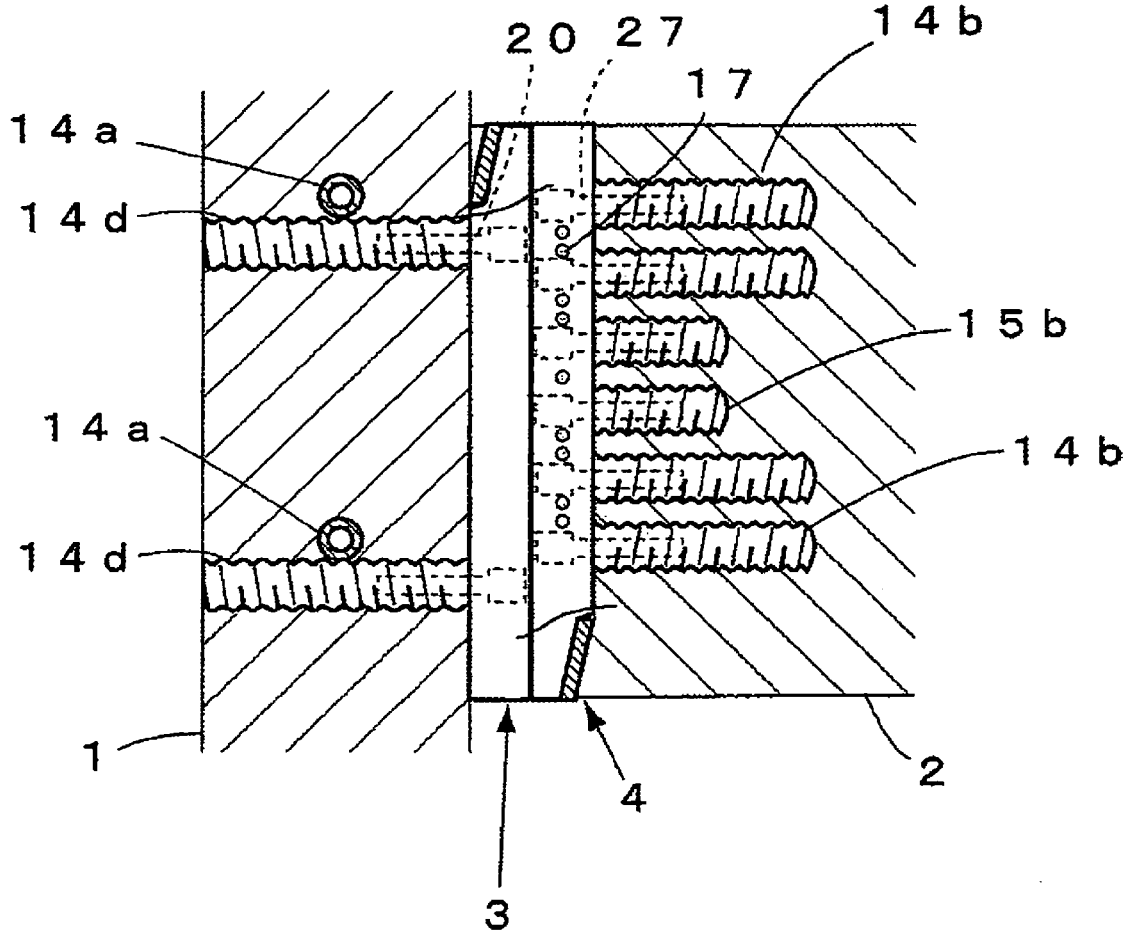
FIG. 8 is a side view to explain the procedure for mounting the connection hardware for wooden building in a fifth embodiment.

FIG. 8 is a side view to show a fifth embodiment of the connection hardware for wooden building of the present invention. In this connection hardware, counterbored holes 20 and 27, into which bolts for fixing the basic hardware 3 and the subsidiary hardware 4 are to be inserted at the time of connection, are arranged with their positions deviated from each other in vertical direction. This is done for the purpose of avoiding the interference between lag screws 14*a* and 14*d*, which are to be penetrated into the longitudinal member when the lateral member 2 is connected with two or more lateral surfaces of the longitudinal member 1. For this purpose, the point where the lag screw 14*b* directed to the lateral member 2 is to be screwed in is arranged at the position deviated in vertical direction from that of the lag screw 14*d*, which is to be penetrated into the longitudinal member 1 so that the height of the lateral member 2 to be connected to two or more lateral surfaces of the longitudinal member 1 will be suitable for the purpose.

According to the connection hardware of the present embodiment, only one type of connection hardware will suffice, and this will be enough for the use at various connecting points and will suit various types of connecting modes.

INDUSTRIAL APPLICABILITY

With the arrangement as described above, the connection hardware for wooden building according to the present invention can be widely applied as the connection hardware for wooden building where longitudinal members (such as pillars, beams, crossbeams, etc.) are to be connected with lateral members (such as beams, crossbeams, etc.).

The invention claimed is:

1. Apparatus for connecting members of a wooden building, comprising:

a subsidiary hardware to be fixed on an end surface of a lateral member, said subsidiary hardware accommodated in an accommodation space provided on an end surface of said lateral member, said subsidiary hardware having through-holes through which fastening pieces passing from a lateral surface of the lateral member are inserted, said subsidiary hardware being fixedly connected by mounting pieces on a bottom surface of said accommodation space, said subsidiary hardware including an upper receiving portion having a first longitudinal hole surrounded by a first band strip and an outer surface of the subsidiary hardware, the first band strip defining a first inner surface extending between a bottom edge and a top edge, the portion of the first inner surface generally opposite the outer surface of the subsidiary hardware inclining from the bottom edge to the top edge of the first band strip and a lower tapered portion having a first inclined surface that inclines upwards toward the lateral member from a lower part of said subsidiary hardware;

a basic hardware to be fixed on a lateral surface of a longitudinal member, said basic hardware connected by means of mounting pieces on the lateral surface of said longitudinal member, said basic hardware having an upper tapered portion engageable with said first longitudinal hole of said subsidiary hardware and a second inclined surface that inclines downwards toward said longitudinal member, said basic hardware including a lower receiving portion having a second longitudinal hole surrounded by a second band strip and an outer surface of the basic hardware, the second band strip defining a second inner surface extending between a top edge and a bottom edge, the portion of the second inner surface generally opposite the outer surface of the basic hardware inclining from the bottom edge to the top edge of the second band strip and engageable with the lower tapered portion of said subsidiary hardware;

said first inclined surface facing the bottom surface of said accommodation space;

said second inclined surface facing the lateral surface of said longitudinal member;

said first inclined surface and said second inner surface arranged to be in contact with each other in such a manner that said first inclined surface slides along said second inner surface to generate an attracting force therebetween when said lower tapered portion of said subsidiary hardware is inserted into said lower receiving portion of said basic hardware;

said second inclined surface and said first inner surface arranged to be in contact with each other in such a manner that said first inner surface slides along said second inclined surface to generate an attracting force therebetween when said upper tapered portion of said basic hardware is inserted into said upper receiving portion of said subsidiary hardware;

each of said first longitudinal hole and an upper end portion of said basic hardware having a corresponding shape and size so that said upper end portion of said basic hardware does not move in any direction normal to the longitudinal axis of said subsidiary hardware when said upper end portion is fully inserted into said first longitudinal hole; and each of said second longitudinal hole and a lower end portion of said subsidiary hardware having a corresponding shape and size so that said lower end portion of said subsidiary hardware does not move in any direction normal to the longitudinal axis of said basic hardware when said lower end portion is fully inserted into said second longitudinal hole.

2. Apparatus for connecting members of a wooden building, comprising:

a subsidiary hardware to be fixed on an end surface of a lateral member, said subsidiary hardware accommodated in an accommodation space provided on an end surface of said lateral member, said subsidiary hardware having through-holes, through which fastening pieces passing from a lateral surface of the lateral member are inserted, said subsidiary hardware including an upper receiving portion having a first longitudinal hole surrounded by a first band strip and an outer surface of the subsidiary hardware, the first band strip defining a first inner surface extending between a bottom edge and a top edge, the portion of the first inner surface generally opposite the outer surface of the subsidiary hardware inclining from the bottom edge to the top edge of the first band strip and a lower tapered portion having a first inclined surface that inclines upwards toward said lateral member;

first mounting pieces for fixedly connecting said subsidiary hardware to a bottom surface of said accommodation space, said first mounting pieces including a plurality of first screw receiving means which are to be embedded in said lateral member, and a plurality of first fixing bolts for fixing said subsidiary hardware to said lateral member in such a manner that each of said first fixing bolts penetrates a corresponding through-hole made in said subsidiary hardware and that said first fixing bolt is received in a threaded hole of one of said first screw receiving means;

a basic hardware to be fixed on a lateral surface of a longitudinal member, said basic hardware having an upper tapered portion engageable with said first longitudinal hole of said subsidiary hardware and a second inclined surface that inclines downwards toward said longitudinal member, said basic hardware including a lower receiving portion having a second longitudinal hole surrounded by a second band strip and an outer surface of the basic hardware, the second band strip defining a second inner surface extending between a top edge and a bottom edge, the portion of the second inner surface generally opposite the outer surface of the basic hardware inclining from the bottom edge to the top edge of the second band strip and engageable with the lower tapered portion of said subsidiary hardware;

second mounting pieces for fixedly connecting said basic hardware to said lateral surface of said longitudinal member, said second mounting pieces including a plurality of second screw receiving means which are to be embedded in said longitudinal member, and a plurality of second fixing bolts for fixing said basic hardware to said longitudinal member in such a manner that each of said second fixing bolts penetrates a corresponding through-hole made in said basic hardware and that said second fixing bolt is received in a threaded hole of one of said second screw receiving means;

said first inclined surface facing the bottom surface of said accommodation space;

said second inclined surface facing the lateral surface of said longitudinal member;

said first inclined surface and said second inner surface arranged to be in contact with each other in such a manner that said first inclined surface slides along said second inner surface to generate an attracting force therebetween when said lower tapered portion of said subsidiary hardware is inserted into said lower receiving portion of said basic hardware;

said second inclined surface and said first inner surface arranged to be in contact with each other in such a manner that said first inner surface slides along said second inclined surface to generate an attracting force therebetween when said upper tapered portion of said subsidiary hardware is inserted into said upper receiving portion of said basic hardware;

each of said first longitudinal hole and an upper end portion of said basic hardware having a corresponding shape and size so that said upper end portion of said basic hardware does not move in any direction normal to the longitudinal axis of said subsidiary hardware when said upper end portion is fully inserted into said first longitudinal hole; and each of said second longitudinal hole and a lower end portion of said subsidiary hardware having a corresponding shape and size so that said lower end portion of said subsidiary hardware does not move in any direction normal to the longitudinal axis of said basic hardware when said lower end portion is fully inserted into said second longitudinal hole.

* * * * *